US005128583A

United States Patent [19]

Ma

[11] Patent Number: 5,128,583

[45] Date of Patent: Jul. 7, 1992

[54] SPARK PLUG INSULATOR STRUCTURE

[75] Inventor: Thomas T. Ma, South Woodham Ferrers, England

[73] Assignee: Ford Motor Company, Dearborn, Mich.

[21] Appl. No.: 573,314

[22] PCT Filed: May 17, 1989

[86] PCT No.: PCT/GB89/00529

§ 371 Date: Sep. 28, 1990

§ 102(e) Date: Sep. 28, 1990

[87] PCT Pub. No.: WO89/11745

PCT Pub. Date: Nov. 30, 1989

[30] Foreign Application Priority Data

May 28, 1988 [GB] United Kingdom ..... 8812772

[51] Int. Cl.[5] ..... H01T 13/16; H01T 13/36

[52] U.S. Cl. ..... 313/137; 313/130; 313/139; 313/143; 313/141; 313/142

[58] Field of Search ..... 313/137, 143, 130, 139, 313/141, 142

[56] References Cited

U.S. PATENT DOCUMENTS 4,289,990 9/1987 Mayumi et al. ..... 313/143

4,870,319 9/1989 Benedikt et al. ..... 313/130

FOREIGN PATENT DOCUMENTS 3152877 8/1985 Fed. Rep. of Germany .

*Primary Examiner*—Donald J. Yusko

*Assistant Examiner*—Nimesh Patel

*Attorney, Agent, or Firm*—Peter Abolins; Clifford L. Sadler

[57] ABSTRACT

A spark plug is disclosed having a metal body 18, a center electrode 16 and an insulator 14 surrounding the center electrode, the part of the insulator disposed within the combustion chamber being separated by an annular gap from the metal body of the spark plug. In order to reduce cycle to cycle variations, a filler 12 of very poor thermal conductivity is used to fill the gap between the insulator 14 and the body 18 to prevent gas movement in this gap, thereby preventing the gap from forming part of the combustion chamber.

1 Claim, 1 Drawing Sheet

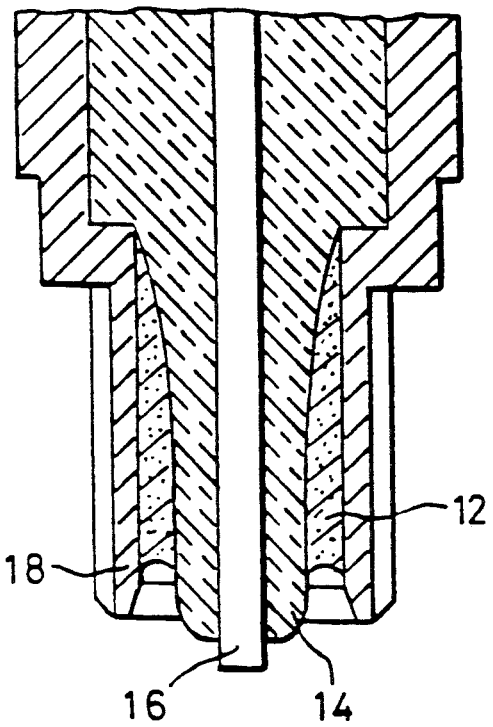
12
18
16
14

SPARK PLUG INSULATOR STRUCTURE

BACKGROUND OF THE INVENTION

The present invention relates to spark plugs for spark ignited internal combustion engines.

Considerable variations in combustion are noticed from one cycle of operation of an internal combustion engine to another even when there is no irregularity in the breathing or fuelling of the engine. Some cycles have rapid flame propagation while others have slower flame propagation making it difficult to achieve precise ignition timing in all cycles.

This effect has previously been noted and attempts have been made to predict fast and slow burn cycles in order to adjust the ignition timing accordingly but these ignition systems have not proved simple to implement.

Rather than combat the cycle to cycle variations after they have occurred, the present invention seeks to remove a major cause of these variations.

SUMMARY OF THE INVENTION

According to the present invention, there is provided a spark plug having a metal body, a center electrode and an insulator surrounding the center electrode, the end of the insulator nearer the spark gap being spaced by an annular gap from the metal body of the spark plug, characterised in that the annular gap is filled with an insulating material of low thermal capacity to prevent combustion gases from entering between the insulator and the body of the spark plug.

In a spark plug, it is important that the center electrode run at a high temperature, to prevent its fouling. It is also important to ensure that the surface path from the center electrode to the body of the spark plug should be as long as possible in order to prevent arcing or tracking along the surface cf the insulator, which would prevent the spark from flying across the spark gap. For these reasons, it is usual for the center electrode to be surrounded by an insulator which is itself spaced from the body of the plug. This configuration prolongs the surface of the insulator to prevent tracking and also creates a thermal barrier preventing the cooling of the insulator surrounding the center electrode by the body of the plug to permit the plug to run at the required elevated temperature.

However, it is believed that the poor scavenging of gases from this small gap, which forms part of the combustion chamber, results in an erratic flow in the vicinity of the spark gap. It is known that the flow conditions and the mixture strength in the immediate vicinity of the spark gap are responsible to a great extent for the initiation of the flame and this in turns affects the speed of combustion and flame propagation in the burn cycle.

Various previously unexplained experimental facts suggest that the presence of an air gap in the spark plug is a cause of cycle to cycle variations. For example, it has been found that injecting air into the spark plug air gap reduces such variations. Also, measured values of mixture strength at the spark plug gap have been found to remain substantially constant despite significant changes in overall mixture strength. A still further fact in support of the conclusion that cycle to cycle variations are caused by the spark plug air gap is that high swirl combustion chambers, having better scavenging, are less prone to such variations.

The invention recognises this cause of variations between burn cycles and alleviates the problem by preventing gases trapped in the spark plug from participating in the combustion process.

There have been previous proposals to place an insert in the gap between the insulator surrounding central electrode and the body of the spark plug or to restrict the flow into the gap surrounding the insulator. However, none of the prior art arrangements reduces cycle to cycle variations and instead they are mostly concerned with the temperature characteristics of the spark plug or with the prevention of fouling.

U.S. Pat. Nos. 3,612,931 and 3,743,877 describe spark plugs incorporating a heat shunt to give the effect of a hot plug at lower operating temperatures. The heat shunt is a thermally conductive ring bonded on the insulator nose.

In GB-2 146 071B, a heat pipe is disposed in the space between the insulator and the body of the plug. This is done to provide means for varying the heat range of the spark plug automatically to keep the plug at its most effective temperature.

In U.S. Pat. Nos. 4,289,990 and 4,211,952 a constriction is formed in the gap which surrounds the insulator to hinder the flow of gases in order to prevent a build up of carbon on the insulator.

DETAILED DESCRIPTION OF THE PREFERRED EMBODIMENT

In the preferred embodiment of the invention, the gap between the insulator and the body of the spark plug is filled with a cellular filler of poor thermal conductivity capable of withstanding the combustion temperatures and pressures yet able to accommodate thermal expansion. A paint formed of micro-balloons of ceramic material is known which has extremely poor thermal conductivity. A filler formed of such micro-balloons suspended in a binder can ensure that the center electrode is not cooled by heat flow through the filler.

The invention will now be described further, by way of example, with reference to the accompanying drawing which is a partial section through a spark plug of the invention.

The spark plug in the drawing comprises a metal body 18, and a center electrode 16 spaced from the body 18 by an insulator 14. The earth electrode which defines the spark gap lies in a plane different from that of the drawing and is not shown.

In a conventional spark plug, the gap between the insulator 14 and the metal body 18 is empty. This, as earlier described, was done in the prior art to maintain a desired temperature of the insulator surface to prevent fouling and to ensure that tracking does not occur over the surface of the insulator 14.

It has now been found that the gap within the spark plug forms a part of the combustion chamber which is poorly scavenged. Burnt gases remain in this gap at the end of the combustion cycle and can interfere with the initiation of combustion in the next cycle. In the present invention, it is required to prevent gases from entering the gap between the insulator 14 and the body 18 of the spark plug, without at the same time cooling the center electrode or providing a short circuit path over which tracking can occur.

To meet these objectives, the gap between the insulator 14 and the body 18 is filled with a filler 12 having very poor thermal conductivity. The insulator 14 is still allowed to heat up as little heat flows across the filler 12 and furthermore the surface of the filler 12, being poorly cooled, attains high temperatures (essentially the same temperature as the combustion gases) and prevents any carbon deposits which can cause tracking.

A paint (a spin-off from space technology) has recently become available which exhibits extremely poor thermal conductivity. A red hot sheet of steel having a coating of such a paint at one end, can safely be hand held at its painted end. This paint comprises micro-balloons of a ceramic material, the trapped air being the cause of the very poor conductivity.

If such micro-balloons are mixed with a binder to form a filler, then the resulting filler should have comparable thermal conductivity and should be particularly suitable for filling the gap between the insulator 14 and the body 18 of the spark plug.

Apart from the presence of the filler 12, the spark plug is essentially conventional and for this reason further explanation of the construction and the manufacture of the spark plug is not deemed necessary.

I claim:

1. A spark plug having a metal body (18), a center electrode (16), an insulator (14) surrounding the center electrode, and an air spark gap between said metal body and said center electrode, the end of the insulator (14) nearer the spark gap being spaced by an annular gap from the metal body (18) of the spark plug, characterized in that at least the part of the annular gap remote from the spark gap is filled with an insulating material (12) of low thermal capacity to prevent combustion gases from entering deeply between the insulator (16) and the metal body (18) of the spark plug, wherein the insulating material is formed of a binder and a suspension of micro-balloons of ceramic material.

* * * * *